US011291262B2

(12) United States Patent
Halldin

(10) Patent No.: US 11,291,262 B2
(45) **Date of Patent: *Apr. 5, 2022**

(54) HELMET WITH SLIDING FACILITATOR ARRANGED AT ENERGY ABSORBING LAYER

(71) Applicant: MIPS AB, Taby (SE)

(72) Inventor: Peter Halldin, Enskede (SE)

(73) Assignee: MIPS AB

( * ) Notice: Subject to any disclaimer, the term of this patent is extended or adjusted under 35 U.S.C. 154(b) by 0 days.

This patent is subject to a terminal disclaimer.

(21) Appl. No.: 17/101,516

(22) Filed: Nov. 23, 2020

(65) Prior Publication Data

US 2021/0076768 A1 Mar. 18, 2021

Related U.S. Application Data

(63) Continuation of application No. 16/222,816, filed on Dec. 17, 2018, now Pat. No. 10,874,160, which is a (Continued)

(30) Foreign Application Priority Data

May 7, 2010 (SE) ..... 1050458-7

(51) Int. Cl.
*A42B 3/14* (2006.01)
*A42B 3/06* (2006.01)
(Continued)

(52) U.S. Cl.
CPC ..... *A42B 3/064* (2013.01); *A42B 3/066* (2013.01); *A42B 3/12* (2013.01); *A42B 3/125* (2013.01);
(Continued)

(58) Field of Classification Search
CPC ..... A42B 3/064; A42B 3/12; A42B 3/121; A42B 3/125; A42B 3/10; A42B 3/14; A42B 3/145; A42B 3/069
(Continued)

(56) References Cited

U.S. PATENT DOCUMENTS 3,039,108 A * 6/1962 Lohrenz ..... A42B 3/10 2/412
3,092,837 A 6/1963 Austin
(Continued)

FOREIGN PATENT DOCUMENTS

EP 0954993 11/1999
EP 2428129 3/2012
(Continued)

OTHER PUBLICATIONS

Extended European Search Report dated Apr. 5, 2012, for European Patent Application No. 11777656.3. 6 pages.
(Continued)

*Primary Examiner* — Robert H Muromoto, Jr.
(74) *Attorney, Agent, or Firm* — Perkins Coie LLP

(57) ABSTRACT

A helmet having an energy absorbing layer (2) and a sliding facilitator (5) is provided. The sliding facilitator is provided inside of the energy absorbing (2). A method of manufacturing a helmet having a sliding facilitator is farther provided. The method having the steps of: providing an energy absorbing layer in the mould, and providing a sliding facilitator for contacting the energy absorbing layer.

5 Claims, 8 Drawing Sheets

Related U.S. Application Data continuation of application No. 15/586,154, filed on May 3, 2017, now Pat. No. 10,212,979, which is a continuation of application No. 15/209,653, filed on Jul. 13, 2016, now Pat. No. 9,955,745, which is a continuation of application No. 14/839,538, filed on Aug. 28, 2015, now Pat. No. 9,603,406, which is a continuation of application No. 14/047,763, filed on Oct. 7, 2013, now abandoned, which is a continuation of application No. 13/263,981, filed as application No. PCT/SE2011/050556 on May 3, 2011, now Pat. No. 8,578,520.

(60) Provisional application No. 61/333,817, filed on May 12, 2010.

(51) Int. Cl.
*A42B 3/12* (2006.01)
*A42B 3/04* (2006.01)

(52) U.S. Cl.
CPC ..... *A42B 3/14* (2013.01); *A42B 3/145* (2013.01); *A42B 3/147* (2013.01)

(58) Field of Classification Search
USPC ..... 2/411, 412, 413, 425
See application file for complete search history.

(56) References Cited

U.S. PATENT DOCUMENTS

| | | | | | |
|---|---|---|---|---|---|
| 3,116,488 | A | | 1/1964 | Zibikowski | |
| 3,447,162 | A | | 6/1969 | Aileo | |
| 3,471,866 | A | | 10/1969 | Raney | |
| 4,012,794 | A | * | 3/1977 | Nomiyama | A42B 3/064 2/411 |
| 4,064,565 | A | * | 12/1977 | Griffiths | A42B 3/121 2/412 |
| 4,185,331 | A | | 1/1980 | Nomiyama | |
| 4,307,471 | A | * | 12/1981 | Lovell | A42B 3/12 2/411 |
| 4,472,472 | A | * | 9/1984 | Schultz | A42B 3/065 428/178 |
| 5,204,998 | A | * | 4/1993 | Liu | F16F 1/3732 2/411 |
| 5,376,318 | A | * | 12/1994 | Ho | A42B 3/061 264/132 |
| 5,718,968 | A | * | 2/1998 | Cutler | B29C 44/06 428/218 |
| 5,815,846 | A | * | 10/1998 | Calonge | A42B 3/121 2/413 |
| 5,874,133 | A | * | 2/1999 | Cochran | B29C 43/003 427/299 |
| 6,446,270 | B1 | * | 9/2002 | Durr | A42B 3/061 2/412 |
| 6,658,671 | B1 | * | 12/2003 | Von Holst | A42B 3/064 2/412 |
| 7,341,776 | B1 | * | 3/2008 | Milliren | A41D 13/05 2/411 |
| 7,774,866 | B2 | * | 8/2010 | Ferrara | F16F 9/0481 2/455 |
| 7,930,771 | B2 | * | 4/2011 | Depreitere | A42B 3/128 2/411 |
| 8,156,569 | B2 | * | 4/2012 | Cripton | A42B 3/0473 2/6.8 |
| 8,182,023 | B2 | * | 5/2012 | Nagwanshi | F16F 1/04 296/187.09 |
| 8,296,863 | B2 | * | 10/2012 | Cripton | A42B 3/064 2/6.8 |
| 8,316,512 | B2 | * | 11/2012 | Halldin | A42B 3/064 24/90.1 |
| 8,575,520 | B2 | | 11/2013 | Halldin | |
| 8,578,520 | B2 | * | 11/2013 | Halldin | A42B 3/145 2/411 |
| 9,603,406 | B2 | * | 3/2017 | Halldin | A42B 3/145 |
| 9,955,745 | B2 | * | 5/2018 | Halldin | A42B 3/147 |
| 10,212,979 | B2 | * | 2/2019 | Halldin | A42B 3/12 |
| 10,874,160 | B2 | * | 12/2020 | Halldin | A42B 3/14 |
| 2001/0032351 | A1 | * | 10/2001 | Nakayama | A42B 3/12 2/412 |
| 2002/0114859 | A1 | * | 8/2002 | Cutler | B29C 44/086 425/192 R |
| 2004/0117896 | A1 | | 6/2004 | Madey et al. | |
| 2004/0168246 | A1 | | 9/2004 | Phillips | |
| 2004/0250340 | A1 | | 12/2004 | Piper et al. | |
| 2005/0262619 | A1 | | 12/2005 | Musal et al. | |
| 2006/0189231 | A1 | * | 8/2006 | Shieh | B32B 5/245 442/30 |
| 2006/0206994 | A1 | | 9/2006 | Rogers et al. | |
| 2009/0302509 | A1 | * | 12/2009 | Debiasi | B29C 44/1271 264/511 |
| 2010/0115686 | A1 | * | 5/2010 | Halldin | A42B 3/064 2/422 |
| 2013/0040524 | A1 | * | 2/2013 | Halldin | B32B 5/022 442/326 |
| 2013/0150473 | A1 | * | 6/2013 | Miyazaki | C08G 18/4072 521/116 |

FOREIGN PATENT DOCUMENTS

| | | |
|---|---|---|
| JP | 2000154417 | 6/2000 |
| JP | 3106274 | 12/2004 |
| JP | 2006312798 | 11/2006 |
| JP | 3131987 | 5/2007 |
| JP | 5998126 | 9/2016 |
| KR | 200189660 | 7/2000 |
| WO | WO 1996/014768 | 5/1996 |
| WO | WO 2006/005143 | 1/2006 |
| WO | WO 2006/022680 | 3/2006 |

OTHER PUBLICATIONS

International Search Report dated Aug. 19, 2011 for International Application No. PCT/SE2011/050556. 5 pages.
Written Opinion of the International Searching Authority dated Aug. 19, 2011 for International Application No. PCT/SE2011/050556. 5 pages.

* cited by examiner

Fig.16
| | Impact direction I, 30 degree, 7mps | | | | | |
|---|---|---|---|---|---|---|
| | Trans. Acc. [g] | | Rot. Acc. [krad/s²] | | Y Rot. Vel. [rad/s] | |
| | Original | MIPS | Original | MIPS | Original | MIPS |
| Max Amp. | 132,1 | 106,4 | 10428,2 | 4968,4 | -36,5 | -26,6 |
| Difference % | 19 | | 52 | | 27 | |
Fig.17
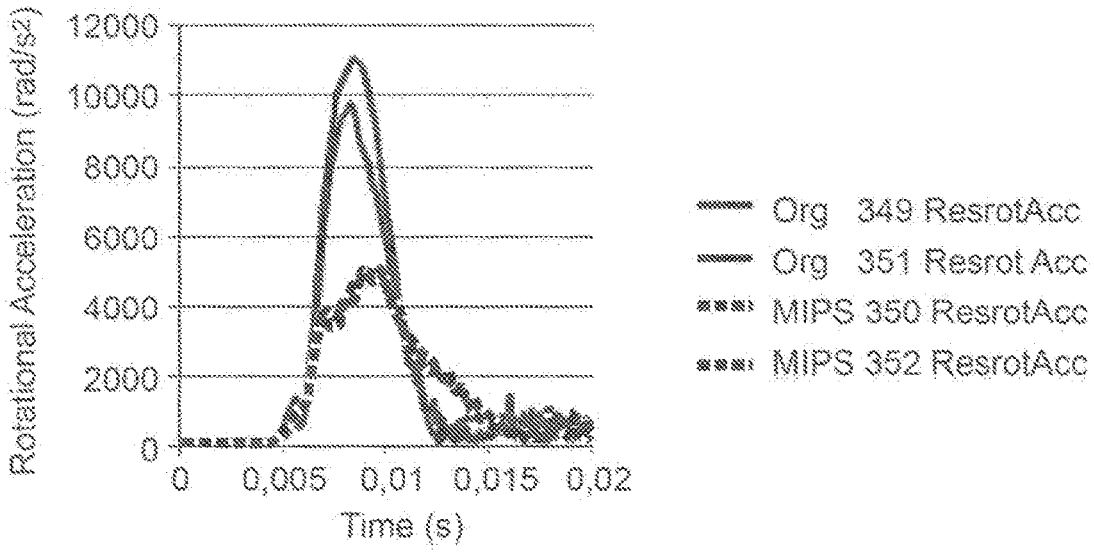
Fig.18
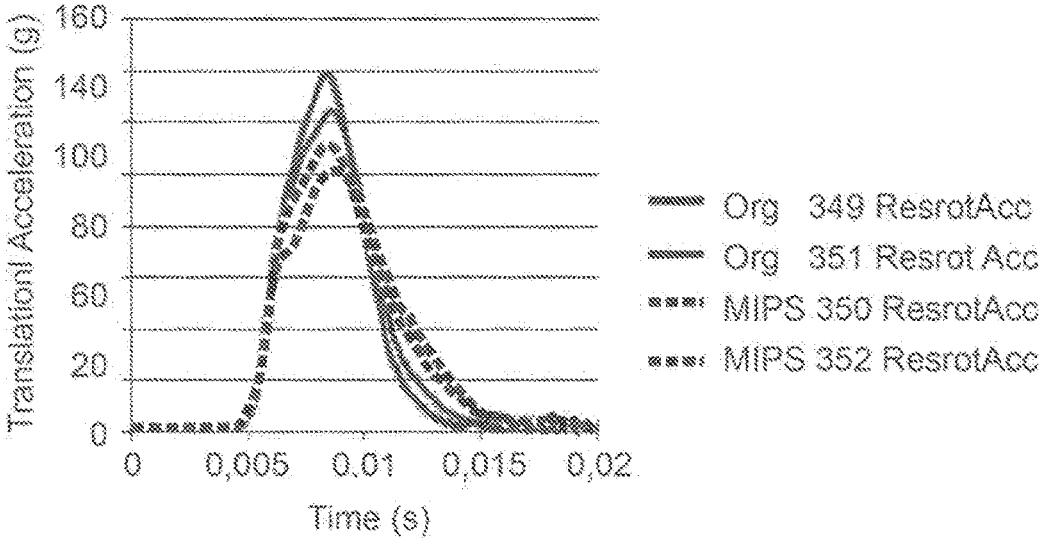

HELMET WITH SLIDING FACILITATOR ARRANGED AT ENERGY ABSORBING LAYER

CROSS-REFERENCE TO RELATED APPLICATIONS

This application is a continuation of U.S. patent application Ser. No. 16/222,816, filed Dec. 17, 2018, which is a continuation of U.S. patent application Ser. No. 15/586,154 (now U.S. Pat. No. 10,212,979), filed May 3, 2017, which is a continuation of U.S. patent application Ser. No. 15/209,653 (now U.S. Pat. No. 9,955,745), filed Jul. 13, 2016, which is a continuation of U.S. patent application Ser. No. 14/839,538 (now U.S. Pat. No. 9,603,406), filed Aug. 28, 2015, which is a continuation of U.S. patent application Ser. No. 14/047,763 (now abandoned), filed Oct. 7, 2013, which is a continuation of U.S. application Ser. No. 13/263,981 (now U.S. Pat. No. 8,578,520), filed Jan. 18, 2012, which is a 371 of International Application No. PCT/SE2011/050556, filed May 3, 2011, which claims the benefit of U.S. Provisional Application No. 61/333,817, filed May 12, 2010 and Sweden Patent Application No. 1050458-7, filed May 7, 2010.

TECHNICAL FIELD

The present invention relates generally to a helmet comprising an energy absorbing layer, with or without any outer shell, and a sliding facilitator being provided inside of the energy absorbing layer.

BACKGROUND ART

In order to prevent or reduce skull and brain injuries many activities requires helmets. Most helmets consist of a hard outer shell, often made of a plastic or a composite material, and an energy absorbing layer called a liner. Nowadays, a protective helmet has to be designed so as to satisfy certain legal requirements which relate to inter aka the maximum acceleration that may occur in the center of gravity of the brain at a specified load. Typically, tests are performed, in which what is known as a dumpy skull equipped with a helmet is subjected to a radial blow towards tire head. This has resulted in modern helmets having good energy-absorption capacity in the case of blows radially against the skull while the energy absorption for other load directions is not as optimal.

In the case of a radial impact the head will be accelerated in a translational motion resulting in a linear acceleration. The translational acceleration can result in fractures of the skull and/or pressure or abrasion injuries of the brain tissue. However, according to injury statistics, pure radial impacts are rare.

On the other hand, a pure tangential hit that results in a pure angular acceleration to the head are rare, too.

The most common type of impact is oblique impact that is a combination of a radial and a tangential force acting at the same time to the head, causing for example concussion of the brain. The oblique impact results in both translational acceleration and rotational acceleration of the brain. Rotational acceleration causes the brain to rotate within the skull creating injuries on bodily elements connecting the brain to the skull and also to the brain itself.

Examples of rotational injuries are on the one hand subdural haematomas, SDH, bleeding as a consequence of blood vessels rupturing, and on the other hand diffuse axonal injuries, DAI, which can be summarized as nerve fibers being over stretched as a consequence of high shear deformations in the brain tissue. Depending on the characteristics of the rotational force, such as the duration, amplitude and rate of increase, either SDH or DAI occur, or a combination of these is suffered. Generally speaking, SDH occur in the case of short duration and great amplitude, while DAI occur in the case of longer and more widespread acceleration loads. It is important that these phenomena are taken into account so as to make it possible to provide good protection for the skull and brain.

The head has natural protective systems that try to dampen these forces using the scalp, the hard skull and the cerebrospinal fluid beneath it During an impact the scalp and the cerebrospinal fluid acts as rotational shock absorber by both compressing and sliding over the skull. Most helmets used today provide no protection against rotational injury.

Important features of for example bicycle, equestrian and ski helmets are that they are well ventilated and have an aerodynamic shape. Modern bicycle helmets are usually of the type in-mould shell manufactured by incorporating a thin, rigid shell during the molding process. This technology allows more complex shapes than hard shell helmets and also the creation of larger vents.

SUMMARY

A helmet comprising an energy absorbing layer and a sliding facilitator being provided inside of the energy absorbing layer is disclosed.

According to one embodiment, the helmet comprises an attachment device for attachment of the helmet to a wearer's head. The attachment device is aimed to be in at least partly contact with the top portion of the head or skull. It may additionally have tightening means for adjustment of the size and grade of attachment to the top portion of the wearer's head. Chin straps or the like are not attachment devices according to the present embodiments of helmets.

The sliding facilitator could be fixated to the attachment device and/or to the inside of the energy absorbing layer for providing slidability between the energy absorbing layer and the attachment device.

Preferably an outer shell is provided outside of the energy absorbing layer. A helmet designed accordingly could be manufactured using in-mould technology, although it is possible to use the disclosed idea in helmets of all types, for example helmets of hard shell type such as motorcycle helmets.

According to yet another embodiment the attachment device is fixated to the energy absorbing layer and/or the outer shell by means of at least one fixation member, which could be adapted to absorb energy and forces by deforming in an elastic, semi-elastic or plastic way. During an impact, the energy absorbing layer acts as an impact absorber by compressing the energy absorbing layer and if an outer shell is used, it will spread out the impact energy over the shell. The sliding facilitator will allow sliding between the attachment device and the energy absorbing layer allowing fora controlled way to absorb the rotational energy otherwise transmitted to the brain. The rotational energy can be absorbed by friction heat, energy absorbing layer deformation or, deformation or displacement of the at least one fixation member. The absorbed rotational energy will reduce the amount of rotational acceleration affecting the brain, thus reducing the rotation of the brain within the skull.

The fixation member could comprise at least one suspension member, having a first and second portion. The first portion of the suspension member could be adapted to be fixated to the energy absorbing layer, and the second portion of the suspension member could be adapted to be fixated to the attachment device.

The sliding facilitator gives the helmet a function (slidability) and can be provided in many different ways. For example it could be a low friction material provided on or integrated with the attachment device on its surface facing the energy absorbing layer and/or provided on or integrated in the inside surface of the energy absorbing layer lacing the attachment device.

A method of manufacturing a helmet comprising a sliding facilitator is further provided. The method comprising the steps of: providing a mould, providing an energy absorbing layer in the mould, and providing a sliding facilitator contacting the energy absorbing layer. According to one embodiment, the method could further comprise the step of fixating an attachment device to at least one of: the shell, the energy absorbing layer and the sliding facilitator using at least one fixation member.

The sliding facilitator provides the possibility of sliding movement in any direction. It is not restricted to movements around certain axes.

Please note that any embodiment or part of embodiment as well as any method or part of method could be combined in any way.

BRIEF DESCRIPTION OF DRAWINGS

The invention is now described by way of example, with reference to the accompanying drawings, in which:

FIG. 16 shows a table of test results, FIG. 17 shows a graph of test results, and FIG. 18 shows a graph of test results.

DETAILED DESCRIPTION

In the following a detailed description of embodiments will be given. It will be appreciated that the figures are for illustration only and are not in any way restricting the scope. Thus, any references to direction, such as "up" or "down", are only referring to the directions shown in the figures.

One embodiment of a protective helmet comprises an energy absorbing layer, and a sliding facilitator being provided inside of the energy absorbing layer. According to one embodiment an in-mold helmet suitable for bicycling is provided. The helmet comprises an outer preferably thin, rigid shell made of a polymer material such as polycarbonate, ABS, PVC, glassfiber, Aramid, Twaron, carbonfibre or Kevlar. It is also conceivable to leave out the outer shell. On the inside of the shell an energy absorbing layer is provided which could be a polymer foam material such as EPS (expanded poly styrene), EPP (expanded polypropylene), EPU (expanded polyurethane) or other structures like honeycomb for example. A sliding facilitator is provided inside of the energy absorbing layer and is adapted to slide against the energy absorbing layer or against an attachment device which is provided for attaching the helmet to a wearer's head. The attachment device is fixated to the energy absorbing layer and/or the shell by means of fixation members adapted to absorb impact energy and forces.

The sliding facilitator could be a material having a low coefficient of friction or be coated with a low friction material: Examples of conceivable materials are PTFE, ABS, JVC, PC, Nylon, fabric materials. It is furthermore conceivable that the sliding is enabled by the structure of the material, for example by the material having a fiber structure such that the fibers slide against each other.

During an impact, the energy absorbing layer acts as an impact absorber by compressing the energy absorbing layer and if an outer shell is used, it will spread out the impact energy over the energy absorbing layer. The sliding facilitator will allow sliding between the attachment device and the energy absorbing layer allowing fora controlled way to absorb the rotational energy otherwise transmitted to the brain. The rotational energy can be absorbed by friction heat, energy absorbing layer deformation or deformation or displacement of the at least one fixation member. The absorbed rotational energy will reduce the amount of rotational acceleration affecting the brain, thus reducing the rotation of the brain within the skull. The risk of rotational injuries such as subdural haematomas, SDH, blood vessel rupturing, concussions and DAI is thereby reduced.

Figure 1:
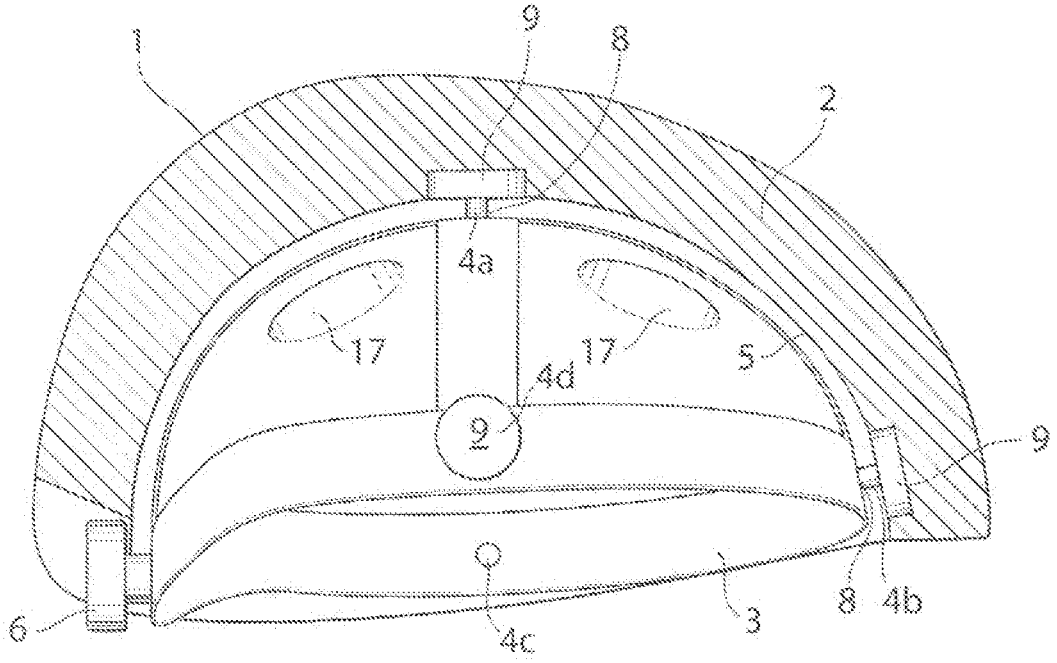
FIG. 1 shows a helmet, according to one embodiment, in a sectional view.

FIG. 1 shows a helmet according to one embodiment in which the helmet comprises an energy absorbing layer 2. The outer surface 1 of the energy absorbing layer 2 may be provided from the same material as the energy absorbing layer 2 or it is also conceivable that the outer surface 1 could be a rigid shell 1 made from a different material than the energy absorbing layer 2. A sliding facilitator 5 is provided inside of the energy absorbing layer 2 in relation to an attachment device 3 provided for attachment of the helmet to a wearer's head. According to the embodiment shown in FIG. 1 the sliding facilitator 5 is fixated to or integrated in the energy absorbing layer 2, however it is equally conceivable that the sliding facilitators is provided on or integrated with the attachment device 3, for the same purpose of providing slidability between the energy absorbing layer 2 and the attachment device 3. The helmet of FIG. 1 has a plurality of vents 17 allowing airflow through the helmet.

The attachment device 3 is fixated to the energy absorbing layer 2 and/or the outer shell 1 by means of four fixation members 4*a*, 4*b*, 4*c* and 4*d* adapted to absorb energy by deforming in an elastic, semi-elastic or plastic way. Energy could also be absorbed through friction creating heat and/or deformation of the attachment device, or any other part of the helmet. According to the embodiment shown in FIG. 1 the four fixation members 4*a*, 4*b*, 4*c* and 4*d* are suspension members 4*a*, 4*b*, 4*c*, 4*d*, having first and second portions 8, 9, wherein the first portions 8 of the suspension members 4*a*, 4*b*, 4*c*, 4*d* are adapted to be fixated to the attachment device 3, and the second portions 9 of the suspension members 4*a*, 4*b*, 4*c*, 4*d* are adapted to be fixated to the energy absorbing layer 2.

The sliding facilitator 5 may be a low friction material, which in the embodiment shown is provided on outside of the attachment device 3 facing the energy absorbing layer 2, however, in other embodiments, it is equally conceivable that the sliding facilitator 5 is provided on the inside of the energy absorbing layer 2. The low friction material could be a waxy polymer, such as PTFE, PFA, FEP, PE and UHMWPE, or a powder material which could be infused with a lubricant. This low friction material could be applied to either one, or both of the sliding facilitator and the energy absorbing layer, in some embodiments the energy absorbing layer itself is adapted to act as sliding facilitator and may comprise a low friction material.

The attachment device could be made of an elastic or semi-clastic polymer material, such as PC, ABS, PVC or PTFE, or a natural fiber material such as cotton cloth. For example, a cap of textile or a net could be forming an attachment device. The cap could be provided with sliding facilitators, like patches of tow friction material. In some embodiments the attachment device itself is adapted to act as a sliding facilitator and may comprise a tow friction material. FIG. 1 further discloses an adjustment device 6 for adjusting the diameter of the head band for the particular wearer. In other embodiments the head band could be an elastic head band in which case the adjustment device 6 could be excluded.

Figure 2:
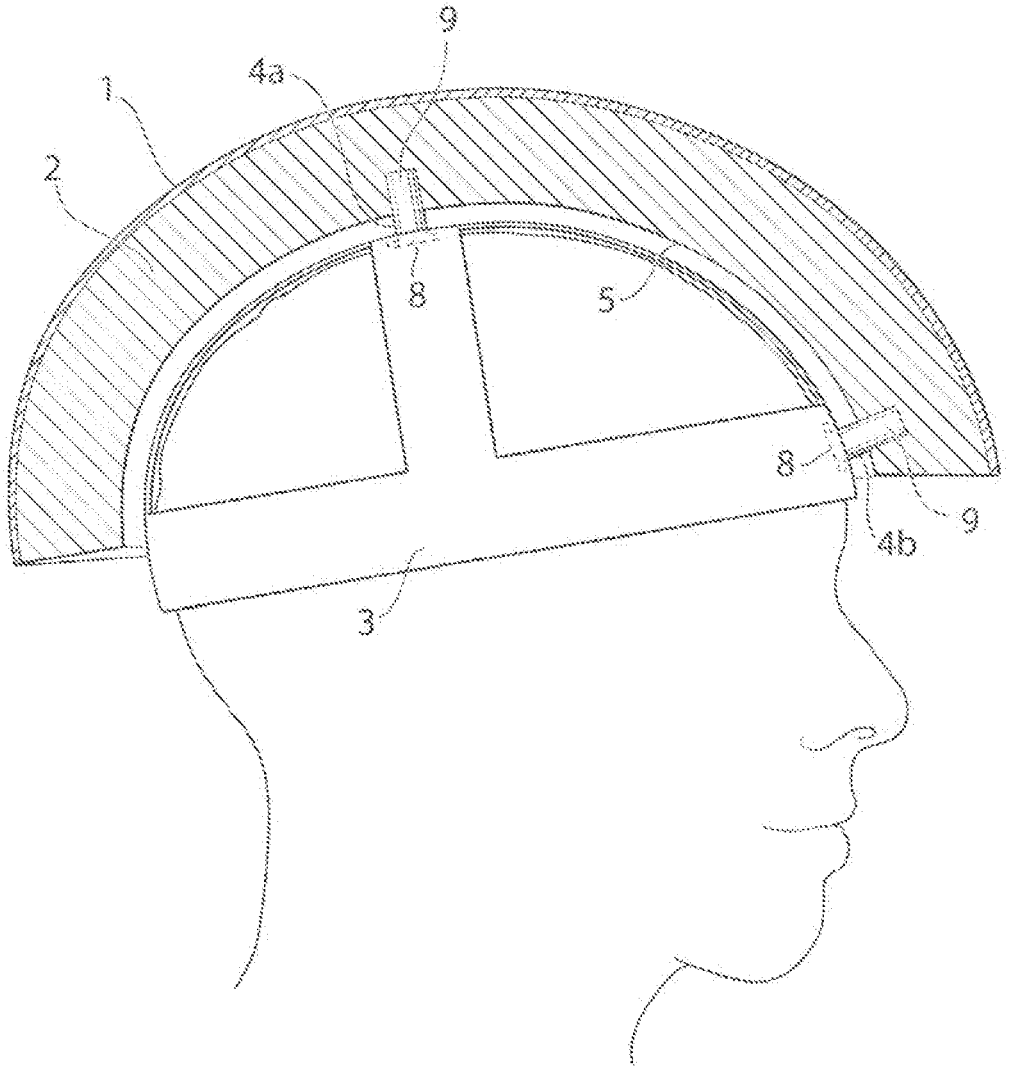
FIG. 2 shows a helmet, according to one embodiment, in a sectional view, when placed on a wearers head.

FIG. 2 shows an embodiment of a helmet similar to the helmet in FIG. 1, when placed on a wearers head. However, in FIG. 2 the attachment device 3 is fixated to the energy absorbing layer by means of only two fixation members 4*a*, *b*, adapted to absorb energy and forces elastically, semi-elastically or plastically. The embodiment of FIG. 2 comprises a hard outer shell 1 mode from a different material than the energy absorbing layer 2.

Figure 3:
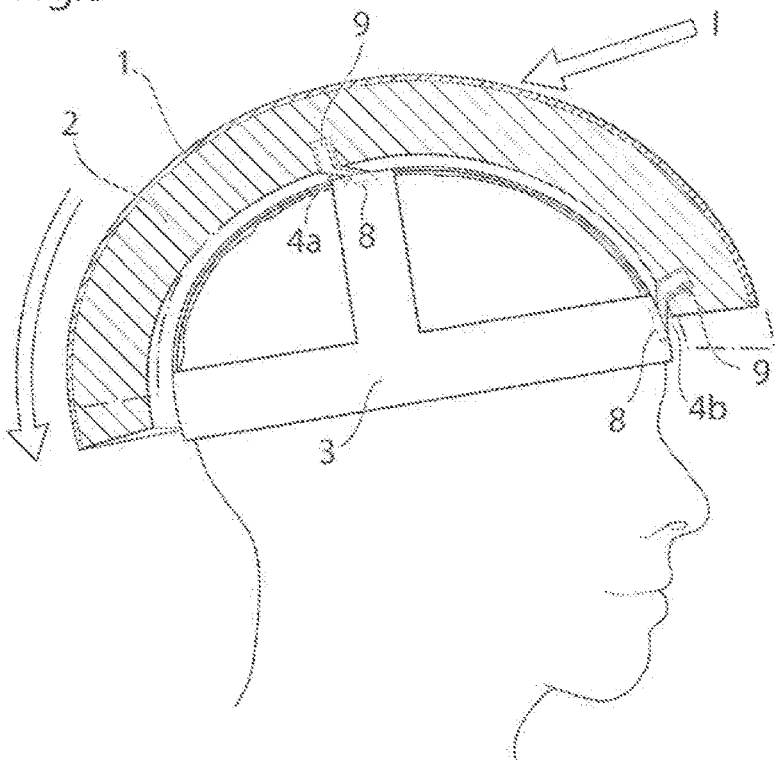
FIG. 3 shows a helmet placed on a wearers head, when receiving a frontal impact.

FIG. 3 shows the helmet according to the embodiment of FIG. 2 when receiving a frontal oblique impact I creating a rotational force to the helmet causing the energy absorbing layer 2 to slide in relation to the attachment device 3. The attachment device 3 is fixated to the energy absorbing layer 2 by means of the fixation members 4*a*, 4*b*. The fixation absorbs the rotational forces by deforming elastically or semi-elastically.

Figure 4:
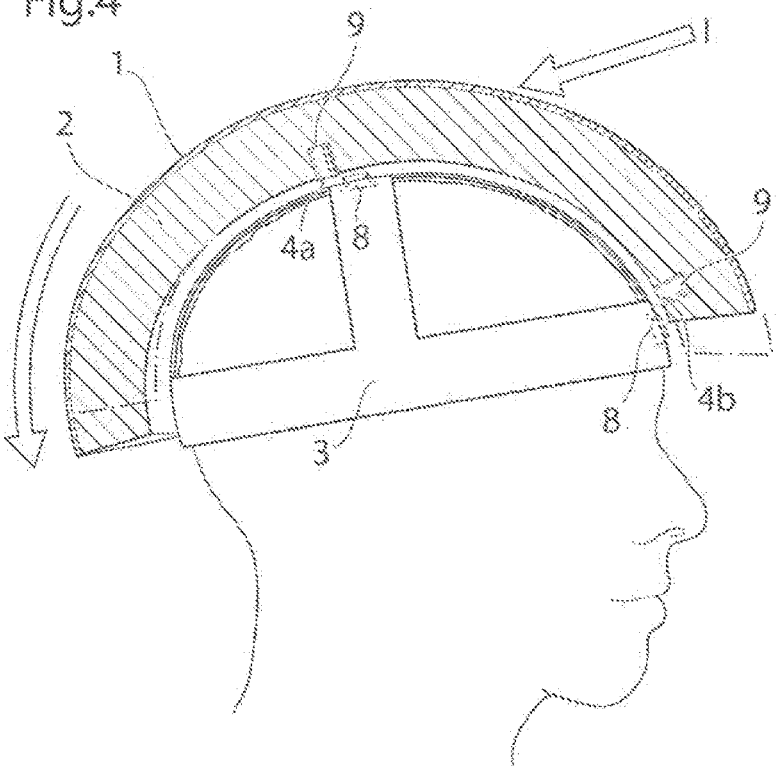
FIG. 4 shows the helmet placed on a wearers head, when receiving a frontal impact.

FIG. 4 shows the helmet according to the embodiment of FIG. 2 when receiving a frontal oblique impact I creating a rotational force to the helmet causing the energy absorbing layer 2 to slide in relation to the attachment device 3. The attachment device 3 is fixated to the energy absorbing layer by means of rupturing fixation members 4*a*, 4*b* which absorbs the rotational energy by deforming plastically and thus needs to be replaced after impact. A combination of the embodiments of FIG. 3 and FIG. 4 is highly conceivable, i.e. a portion of the fixation members ruptures, absorbing energy plastically, while another portion of the fixation members deforms and absorbs forces elastically. In combinational embodiments it is conceivable that only the plastically deforming portion needs to be replaced after impact.

Figure 5:
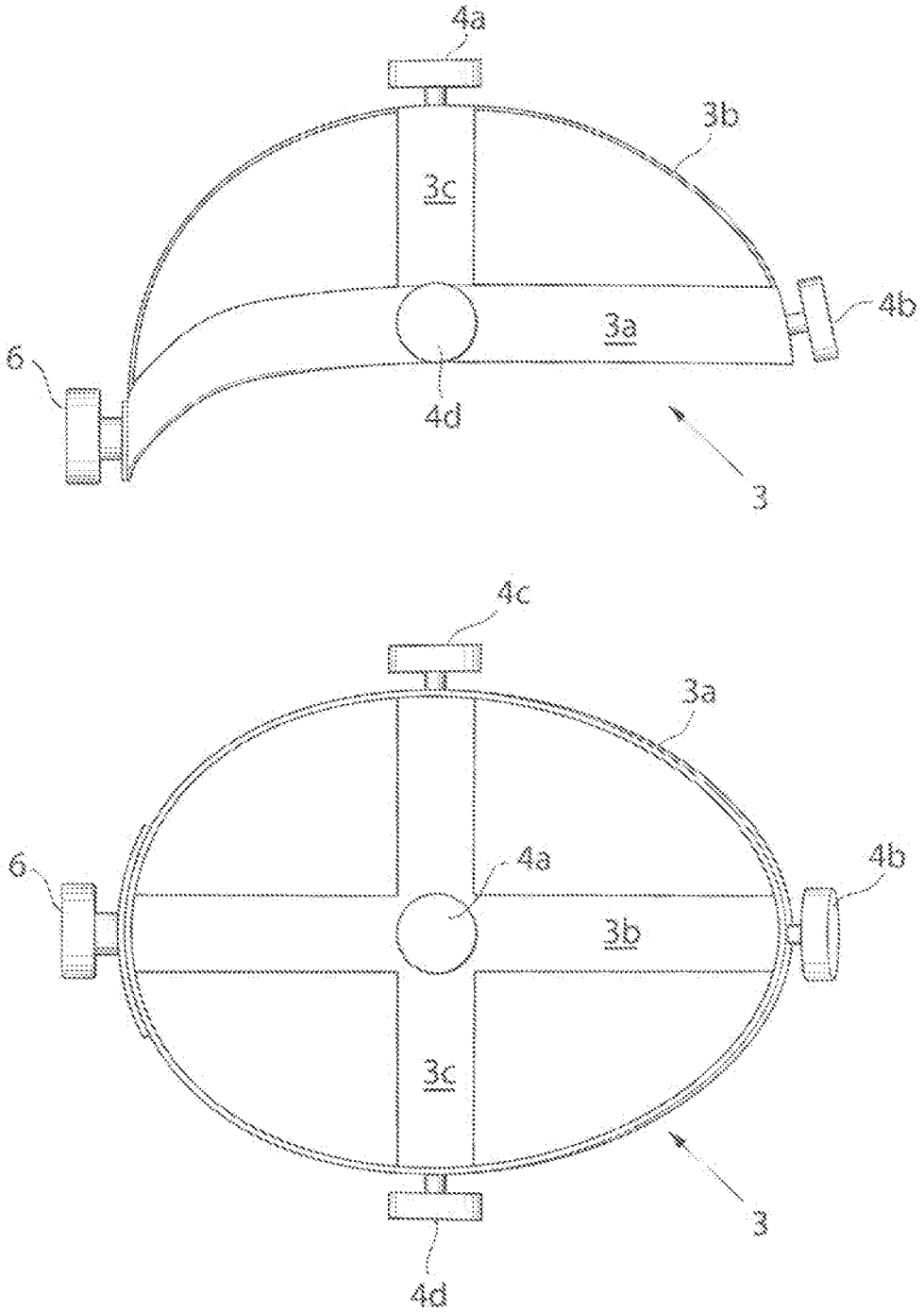
FIG. 5 shows an attachment device in further detail.

The upper part of FIG. 5 shows the outside of an attachment device 3 according to an embodiment in which the attachment device 3 comprises a head band 3*a*, adapted to encircling the wearers head, a dorso-ventral band 3*b* reaching from the wearers forehead to the back of the wearer's head, and being attached to the head band 3*a*, and a latro-lateral 3*c* band reaching from the lateral left side of the wearer's head to the lateral right side of the wearer's head and being attached to the head band 3*a*. Parts or portions of the attachment device 3 may be provided with sliding facilitators, to the shown embodiment, the material of the attachment device may function as a sliding facilitator in itself. It is also conceivable to provide the attachment device 3 with an added low friction material.

FIG. 5 further shows four fixation members 4*a*, 4*b*, 4*c*, 4*d*, fixated to the attachment device 3. In other embodiments the attachment device 3 could be only a head band 3*a*, or an entire cap adapted to entirely cover the upper portion of the wearer's head or arty other design functioning as an attachment device for mounting on a wearer's head.

The tower part of FIG. 5 shows the inside of the attachment device 3 disclosing an adjustment device 6 for adjusting the diameter of the head band 3*a* for the particular wearer, to other embodiments the head band 3*a* could be an elastic head band in which case the adjustment device 6 could be excluded.

Figure 6:
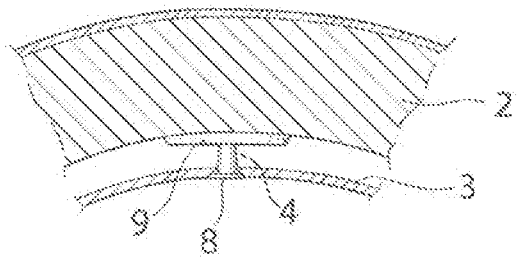
FIG. 6 shows an alternative embodiment of a fixation member.

FIG. 6 shows an alternative embodiment of a fixation member 4 in which the first portion 8 of the fixation member 4 is fixated to the attachment device 3, and the second portion 9 of the fixation device 4 is fixated to the energy absorbing layer 2 by means of an adhesive. The fixation member 4 is adapted to absorb impact energy and forces by deforming in an elastic, semi-elastic or plastic way.

Figure 7:
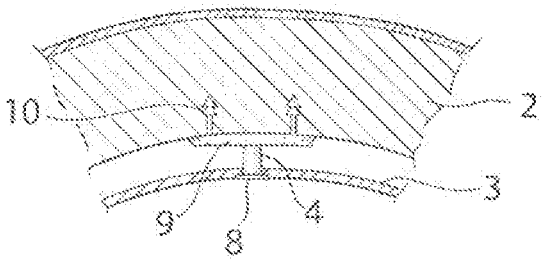
FIG. 7 shows an alternative embodiment of a fixation member.

FIG. 7 shows an alternative embodiment of a fixation member 4 in which the first portion 8 of the fixation member 4 is fixated to the attachment device 3, and the second portion 9 of the fixation device 4 is fixated to the energy absorbing layer 2 by means of mechanical fixation elements 10 entering the material of the energy absorbing layer 2.

Figure 8:
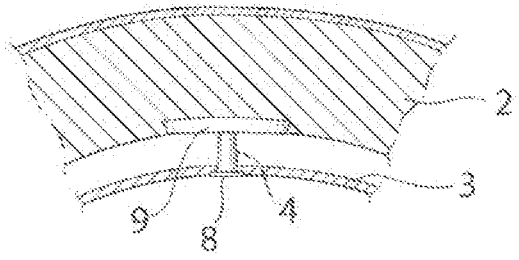
FIG. 8 shows an alternative embodiment of a fixation member.

FIG. 8 shows an alternative embodiment of a fixation member 4 in which the first portion 8 of the fixation member 4 is fixated to the attachment device 3, and the second portion 9 of the fixation device 4 is fixated to inside of the energy absorbing layer 2, for example by molding the fixation device inside of the energy absorbing layer material 2.

Figure 9:
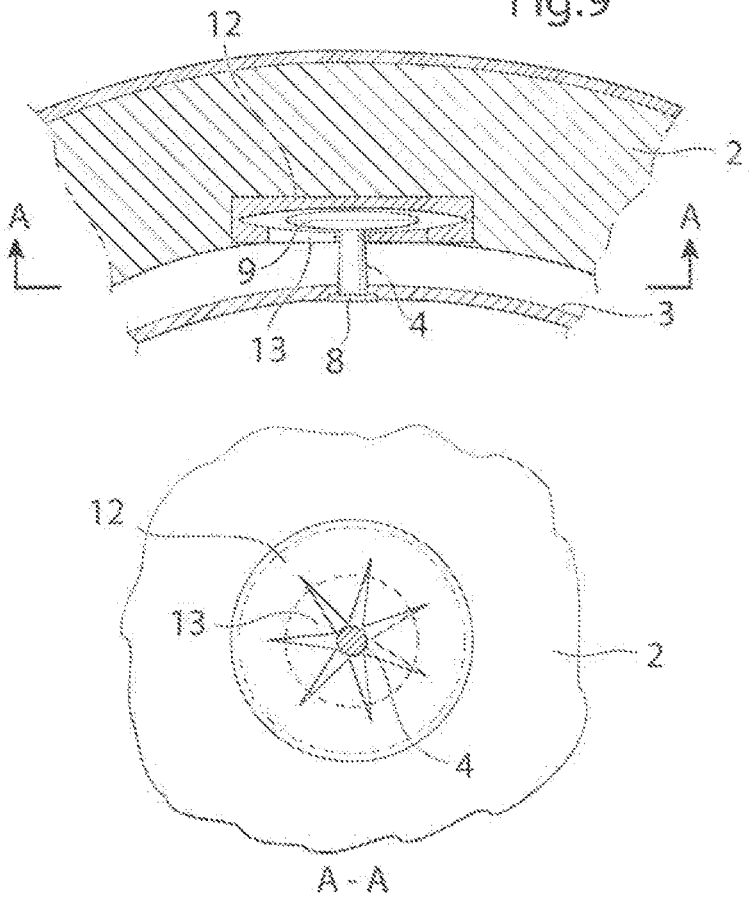
FIG. 9 shows an alternative embodiment of a fixation member.

FIG. 9 shows a fixation member 4 in a sectional view and an A-A view. The attachment device 3 is according to this embodiment attached to the energy absorbing layer 2 by means of the fixation member 4 having a second portion 9 placed in a female part 12 adapted for elastic, semi-elastic or plastic deformation, and a first part 8 connected to the attachment device 3. The female part 12 comprises flanges 13 adapted to flex or deform elastically, semi-elastically or plastically when placed under a large enough strain by the fixation member 4 so that the second portion 9 may leave the female part 12.

Figure 10:
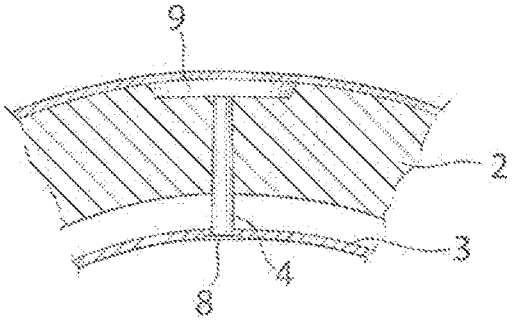
FIG. 10 shows an alternative embodiment of a fixation member.

FIG. 10 shows an alternative embodiment of a fixation member 4 in which the first portion 8 of the fixation member 4 is fixated to the attachment device 3, and the second portion 9 of the fixation device 4 is fixated to inside of the shell 1, all the way through the energy absorbing layer 2. This could be done for example by molding the fixation device 4 inside of the energy absorbing layer material 2. It is also conceivable to place the fixation device 4 through a hole in the shell 1 from the outside of the helmet (not shown).

Figure 11:
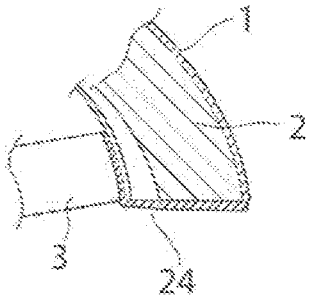
FIG. 11 shows an alternative embodiment of a fixation member.

FIG. 11 shows an embodiment in which the attachment device 3 is fixated to the energy absorbing layer 2 at the periphery thereof by means of a membrane or sealing foam 24, which could be elastic or adapted for plastic deformation.

Figure 12:
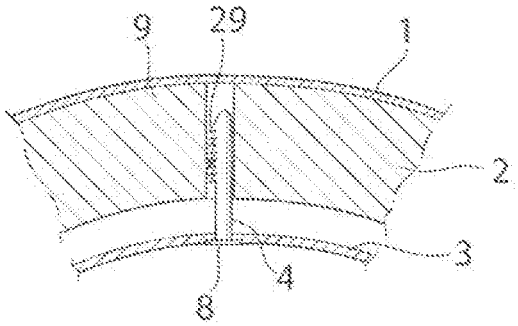
FIG. 12 shows an alternative embodiment of a fixation member.

FIG. 12 shows an embodiment where the attachment device 3 is attached to the energy absorbing layer 2 by means of a mechanical fixation element comprising mechanical engagement members 29, with a self lockup function, similar to that of a self locking tie strap 4.

Figure 13:
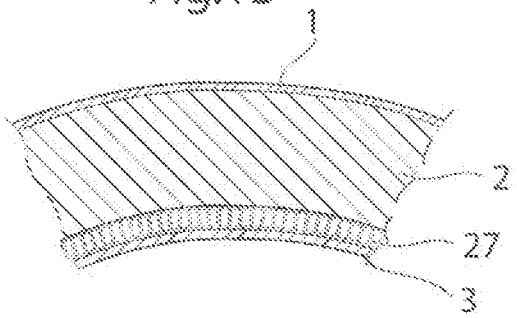
FIG. 13 shows an alternative embodiment of a fixation member.

FIG. 13 shows an embodiment in which the fixating member is an interconnecting sandwich layer 27, such as a sandwich cloth, which could comprise elastically, semi-elastically or plastically deformable fibers connecting the attachment device 3 to the energy absorbing layer 2 and being adapted to shear when shearing forces are applied and thus absorb rotational energy or forces.

Figure 14:
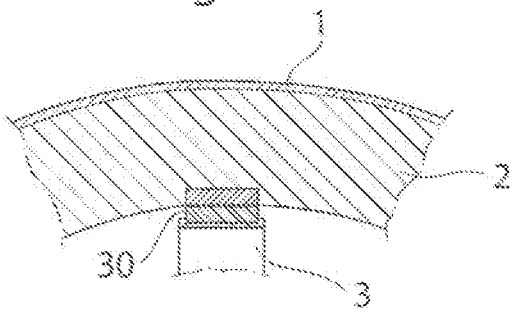
FIG. 14 shows an alternative embodiment of a fixation member.

FIG. 14 shows an embodiment in which the fixating member comprises a magnetic fixating member 30, which could comprise two magnets with attracting forces, such as hypermagnets, or one part comprising a magnet and one part comprising a magnetically attractive material, such as iron.

Figure 15:
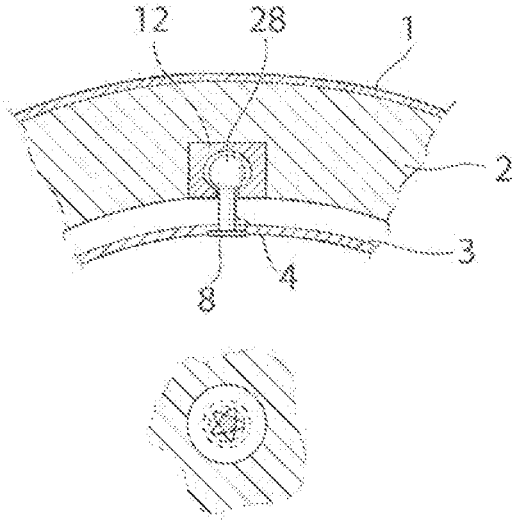
FIG. 15 shows an alternative embodiment of a fixation member.

FIG. 15 shows an embodiment in which the fixating member is re-attachable by means of an elastic male part 28 and/or an elastic female part 12 being detachably connected (so called snap fixation) such that the male part 28 is detached from the female 12 part when a large enough strain is placed on the helmet, in the occurrence of an impact, and the male part 28 can be re-inserted into the female 12 part to regain the functionality. It is also conceivable to snap fixate the fixating member without it being detachable at large enough strain and without being re-attachable.

In the embodiments disclosed herein the distance between the energy absorbing layer and the attachment device could vary from being practically no tiling to being a substantial distance without parting from the concept of the invention.

In the embodiments disclosed herein it is furthermore conceivable that the fixation members are hyperelastic, such that the material absorbs energy elastically but at the same time partially deforms plastically, without failing completely.

In embodiments comprising several fixation members it is further more conceivable that one of the fixation members is a master fixation member adapted to deform plastically when placed under a large enough strain, whereas the additional fixation members are adapted for purely elastic deformation.

FIG. 16 is a table derived from a test performed with a helmet according having a sliding facilitator (MIPS), in relation to an ordinary helmet (Original) without a sliding layer between the attachment device and the energy absorbing layer. The test is performed with a free falling instrumented dummy head which impacts a horizontally moving steel plate. The oblique impact results in a combination of translational and rotational acceleration that is more realistic than common test methods, where helmets are dropped in pure vertical impact to the horizontal impact surface. Speeds of up to 10 m/s (36 km/h) can be achieved both in horizontal and vertical direction. In the dummy head there is a system of nine accelerometers mounted to measure the translational accelerations and rotational accelerations around all axes. In the current test the helmets are dropped from 0.7 meter. This results in a vertical speed of 3.7 m/s. The horizontal speed was chosen to 6.7 m/s, resulting in an impact speed of 7.7 m/s (27.7 km/h) and an impact angle of 29 degrees.

The test discloses a reduction in translational acceleration transmitted to the head, and a large reduction in rotational acceleration transmitted to the head, and in the rotational velocity of the head.

FIG. 17 shows a graph of the rotational acceleration over time with helmets having sliding facilitators (MIFS_350; MIPS_352), in relation to ordinary helmets (Org_349; Org_351) without sliding layers between the attachment device and the dummy head.

FIG. 18 shows a graph of the translational acceleration over time with helmets having sliding facilitators (MIPS_350; MIPS_352), in relation to ordinary helmets (Org_349; Org_351) without sliding layers between the attachment device and the dummy head.

Please note that any embodiment or part of embodiment as well as any method or part of method could be combined in any way. All examples herein should be seen as part of the general description and therefore possible to combine in any way in general terms.

The invention claimed is:

1. A helmet, comprising:

an energy absorbing layer comprising an energy absorbing material that absorbs energy by compression of the energy absorbing material, the energy absorbing layer including an inside surface and an outside surface opposite the inside surface such that the inside surface is adapted to be closer to a wearer's head than the outside surface and the inside surface faces the attachment device;

an attachment device provided for attachment of the helmet to the wearer's head; and a plurality of sliding facilitators, wherein the sliding facilitators are provided between the inside surface of the energy absorbing layer and the attachment device, wherein the sliding facilitators are fixed to at least one of the attachment device or the inside surface of the energy absorbing layer for providing slidability between the energy absorbing layer and the attachment device.

2. The helmet according to claim 1, wherein the sliding facilitators are patches of low friction material.

3. The helmet according to claim 1, wherein the attachment device is fixed to the energy absorbing layer by a fixation member that is able to absorb energy and forces by deforming in an elastic, semi-elastic or plastic way.

4. The helmet according to claim 1, wherein the attachment device is fixed to the energy absorbing layer by a fixation member that comprises at least one suspension member, having a first and second portion, wherein the first portion of the suspension member is adapted to be fixed to the attachment device, and wherein the second portion of the suspension member is adapted to be fixed to the energy absorbing layer.

5. The helmet according to claim 1, wherein the sliding facilitator is a low friction material connected to or integrated with the attachment device on its surface facing the energy absorbing layer and/or provided on or integrated in the inside surface of the energy absorbing layer facing the attachment device.

* * * * *